US005113121A

United States Patent [19]

Lapatovich et al.

[11] Patent Number: 5,113,121

[45] Date of Patent: * May 12, 1992

[54] ELECTRODELESS HID LAMP WITH LAMP CAPSULE

[75] Inventors: Walter P. Lapatovich, Marlboro; Joseph M. Proud, Wellesley Hills; Timothy Fohl, Carlisle, all of Mass.

[73] Assignee: GTE Laboratories Incorporated, Waltham, Mass.

[ * ] Notice: The portion of the term of this patent subsequent to Dec. 3, 2008 has been disclaimed.

[21] Appl. No.: 523,761

[22] Filed: May 15, 1990

[51] Int. Cl.[5] ..... H05B 41/16

[52] U.S. Cl. ..... 315/248; 315/39; 315/344

[58] Field of Search ..... 315/248, 39, 344, 267, 315/236; 333/246; 313/634, 153

[56] References Cited

U.S. PATENT DOCUMENTS

| | | | |
|---|---|---|---|
| 3,138,739 | 6/1964 | Farmer | 315/245 |
| 3,196,312 | 7/1965 | Marrison | 315/171 |
| 3,227,923 | 1/1966 | Marrison | 315/248 |
| 3,757,518 | 9/1973 | Bahr | 315/39 |
| 3,763,392 | 10/1973 | Hollister | 315/248 |
| 3,872,349 | 3/1975 | Spero et al. | 315/39 |
| 3,911,318 | 10/1975 | Spero et al. | 315/39 |
| 3,943,404 | 3/1976 | McNeill | 315/39 |
| 3,993,927 | 11/1976 | Haugsjaa | 315/248 |
| 4,001,632 | 1/1977 | Haugsjaa et al. | 315/39 |
| 4,002,943 | 1/1977 | Regan | 315/39 |
| 4,002,944 | 1/1977 | McNeill | 315/248 |
| 4,041,352 | 8/1977 | McNeill | 315/248 |
| 4,042,850 | 8/1977 | Ury et al. | 315/39 |
| 4,174,492 | 11/1979 | Holle | 315/39 |
| 4,178,534 | 12/1979 | McNeill | 315/248 |
| 4,266,162 | 5/1981 | McNeill | 315/248 |
| 4,266,166 | 5/1981 | Proud et al. | 315/248 |
| 4,359,668 | 11/1982 | Ury | 315/39 |
| 4,504,768 | 3/1985 | Ury | 315/39 |
| 4,633,140 | 12/1986 | Lynch et al. | 315/248 |
| 4,683,525 | 7/1987 | Camm | 362/346 |
| 4,695,694 | 9/1987 | Hill et al. | 219/10.55 D |
| 4,695,757 | 9/1987 | Ury et al. | 313/44 |
| 4,749,915 | 6/1988 | Lynch et al. | 315/248 |
| 4,794,503 | 12/1988 | Wooten et al. | 362/346 |
| 4,812,702 | 3/1989 | Anderson | 315/344 |
| 4,887,008 | 12/1989 | Wood | 315/39 |
| 4,887,192 | 12/1989 | Simpson | 315/248 |
| 4,894,591 | 1/1990 | Witting | 315/248 |
| 4,983,889 | 1/1991 | Roberts | 315/246 |

OTHER PUBLICATIONS

Schiller, S., Byer, R. L., "High Resolution Spectroscopy of Whispering Gallery Modes in Large Dielectric Spheres", Optics Letters, vol. 16, No. 15, Aug. 1, 1991.

*Primary Examiner*—Eugene R. LaRoche
*Assistant Examiner*—A. Zarabian
*Attorney, Agent, or Firm*—Carl F. Ruoff; William E. Meyer

[57] ABSTRACT

An electrodeless lamp may be formed with a capsule having a radiant energy transmissive material defining an approximately cylindrical enclosed volume having an external length less than 20.0 millimeters, and an outer diameter less than 8.0 millimeters. The enclosed volume is filled with a lamp fill excitable by a high frequency electromagnetic field to produce radiant energy. The small size capsule produces a particularly efficient, orientation tolerant arc discharge. The arc is then highly stable as to position, yielding a good optical source to design for. The temperature gradient is small, thereby yielding little thermal stress on the capsule. An electrodeless HID headlamp system may be formed with the efficient capsule from a radio frequency source operating from a the power supply of a typical automobile. The headlamp system includes a high frequency power source, a transmission line, a coupler, an excitable lamp fill captured in a lamp capsule, a reflector and a lens.

22 Claims, 7 Drawing Sheets

ELECTRODELESS HID LAMP WITH LAMP CAPSULE

Basic aspects of this invention are disclosed in a copending application entitled Electrodeless HID Lamp with Microwave Applicator Ser. No. 524,265, filed May 15, 1990 which application is pending.

TECHNICAL FIELD

The invention relates to electric lamps and particularly to high intensity discharge lamps. More particularly the invention is concerned with a power coupler and a lamp capsule for a radio frequency induced high intensity discharge automobile headlamp.

BACKGROUND ART

Auto manufacturers are looking for a rugged, long life, and efficient light source to replace tungsten filament headlamps. Automobiles are harsh environments for a light source. While a vehicle may have a life of ten years, current light sources have lives substantially less than this. Ideally the headlamp should last as long as the motor. If a motor is rated at a life of ten years, a light source should then be capable of roughly 5000 lamp starts, and 5000 hours of lamp operation. Typical tungsten halogen lamp sources in use today are capable of about 1000 starts and 2000 hours of operation. Not only should a lamp not fail abruptly, a lamp's quality should not degrade over time. An automobile light should maintain its level of light output over its operative life. Tungsten halogen lamps currently in use slowly evaporate the tungsten filament. The tungsten is then deposited on the reflector and lens, thereby darkening them and reducing the total useful light output. There is then a need for an automobile headlight capable of a life comparable to the life of a vehicle, for example about 5000 starts, and 5000 hours operation, without loosing much of its initial output, for example less than about 15% of its light output over the life of the lamp.

Automobile headlights are necessarily positioned along the front surfaces of the vehicle. These surfaces are exactly the surfaces that first encounter wind resistance as the vehicle moves. Lamp faces are therefore important to the aerodynamic design of a vehicle. While large lamp faces may be sculpted to conform to a particular aerodynamic design, the economic benefit of mass producing a standardized lamp is then lost. There is a then need to limit the size of lamps to have as little wind resistance as possible. There is a corresponding need to limit lamp size, so as to encourage headlamp standardization.

To make headlamps as small as possible, and as inexpensive as possible, plastic is used for lenses and reflectors, since plastic is both inexpensive and may be precisely molded. The use of plastic and the need for compact headlamps creates a possible problem with over heating. It is possible to melt plastic. It is thus desirable to put as few watts as possible into the assembly, using the energy as efficiently as possible. There is then a need for a headlamp that produces an adequate amount of light with the least amount of energy, and the greatest efficiency.

Electroded HID lamps are commonly produced by press sealing a glass envelope around the electrodes. While the unmelted portions of the envelope may be accurately controlled in manufacture, the wall thicknesses, and wall angles of the press seal are variable. A small but still significant portion of the lamp light passes through or is reflected from the press seal, particularly in smaller or shorter lamps where the seal area is a greater portion of the sphere of illumination. The variable wall features of the press seal cause uncontrolled deflections of light that result in glare. There is then a need for an HID lamp that has accurately controlled wall thicknesses, and wall angles.

Optical path designs could be made ideal in three dimensions, if there were ideal point sources of light. Similarly, display systems could be made ideal in two dimensions if there were ideal linear light sources. Unfortunately, there are no ideal point or linear light sources. As a result, the lighting paths designed in reflector, and lens systems are complex compromises. The compromises are manifested in larger, more complex and more expensive reflectors and lenses, but size and complexity are in conflict with aerodynamics and cost. There is then a need to produce a more nearly ideal point or linear light source to enable simplification of reflectors and lens, or improve the quality of output beams.

Conventional, large size electroded arc lamps can have efficiencies of 80 lumens per watt. The electrode heat losses are a small fraction of the energy input to the lamp, for example a 20 watt loss for a 400 watt lamp. When the lamp size is reduced to a size appropriate for an automobile, for example where the total power input is only about 20 watts, the electrode losses dominate and present a formidable energy budget problem. There is then a need for an energy efficient, small arc discharge lamp.

For high wattages, HID lamps are efficient light sources producing approximately 80 lumens per watt. Unfortunately, at low wattages of about 10 or 20 watts, or less, normal electroded type HID lamps do not operate efficiently. Most of the energy is dissipated in heating the electrodes, and the surrounding envelope material. At higher wattages, for example more than 30 watts, where electroded HID lamps operate more efficiently, more light is produced than desirable for automotive headlights. The light source is also generally larger than convenient with regard to coupling to headlamp reflector optics. The light output of an automobile headlight must be controlled, both as to total lumens, and direction. Excess light may be absorbed, possibly resulting in harmful heating of the absorber. Excess light may also be deflected; but deflected light may result in glare for other drivers, or even though deflected from the beam, may be reflected back to the driver in veiling glare, especially in rain, fog or snow. Excess light is then a problem, and current forms of electroded HID lamps may be regarded as being too powerful for automobiles. There is then a need for an HID lamp that efficiently produces about 2000 to 3000 lumens in the region of 20 to 30 watts.

Examples of the prior art are shown in U.S. Pat. Nos. 3,763,392; 4,812,702; 4,002,943; 4,002,944; 4,002,944; 4,041,352; 4,887,008; and 4,887,192.

U.S. Pat. No. 3,763,392 Hollister broadly shows a light transmissive sphere containing a high pressure gas that is induced to radiate by an induction coil surrounding the sphere.

U.S. Pat. No. 4,812,702 Anderson discloses a toroidal coil for inducing a toroidal discharge in a containment vessel. Anderson emphasizes the use of a V shaped torus cross section.

U.S. Pat. No. 4,002,943 Regan shows an electrodeless lamp with an adjustable microwave cavity. The cavity is designed to be expandable or contractible by threading two wall portions together.

U.S. Pat. No. 4,002,944 McNeill discloses an electrodeless lamp using a resonant cavity to contain the lamp capsule. A tuning element is inserted in the cavity to adjust the cavity resonance.

U.S. Pat. No. 4,041,352 McNeill shows an electrodeless lamp with an included capacitor to assist in lamp starting. On ignition, a switch disconnects the capacitor, allowing full power to flow to the discharge gas.

U.S. Pat. No. 4,887,008 Wood shows an electrodeless lamp in a microwave chamber shielded with a light transmissive mesh opaque to microwave energy.

U.S. Pat. No. 4,887,192 Simpson shows an electrodeless lamp with a well defined, metallic compound resonant cavity.

DISCLOSURE OF THE INVENTION

An electrodeless lamp may be formed with a capsule having a radiant energy transmissive material defining an approximately cylindrical enclosed volume having an internal length about one quarter of the compressed wavelength of the input power, and an internal diameter small enough to suppress radial turbulence in the lamp fill at the temperature and pressure of operation. The preferred embodiment uses helical couplers positioned at opposite ends of the lamp capsule to provide input power. The helical couplers create a substantially axial electric field in conjunction with a coincident magnetic field, thereby inducing electron motion that is substantially constrained to be axial in the lamp capsule. The opposed couplers operate 180° out of phase and thereby form complementary fields at the ends of the lamp capsule. The complementary fields have a vector sum that approximately doubles the field magnitude in the region of the arc chamber. The opposed couplers then simultaneously apply balanced power to both lamp ends, thereby enhancing even lamp capsule luminosity. The small size capsule produces a particularly efficient, even, universal burning arc. The arc is then highly stable as to position, yielding a good optical source for designing beam patterns. The thermal gradients in the small capsule are small, yielding little or no thermal stress on the capsule, thereby enhancing durability.

BEST MODE FOR CARRYING OUT THE INVENTION

Figure 1:
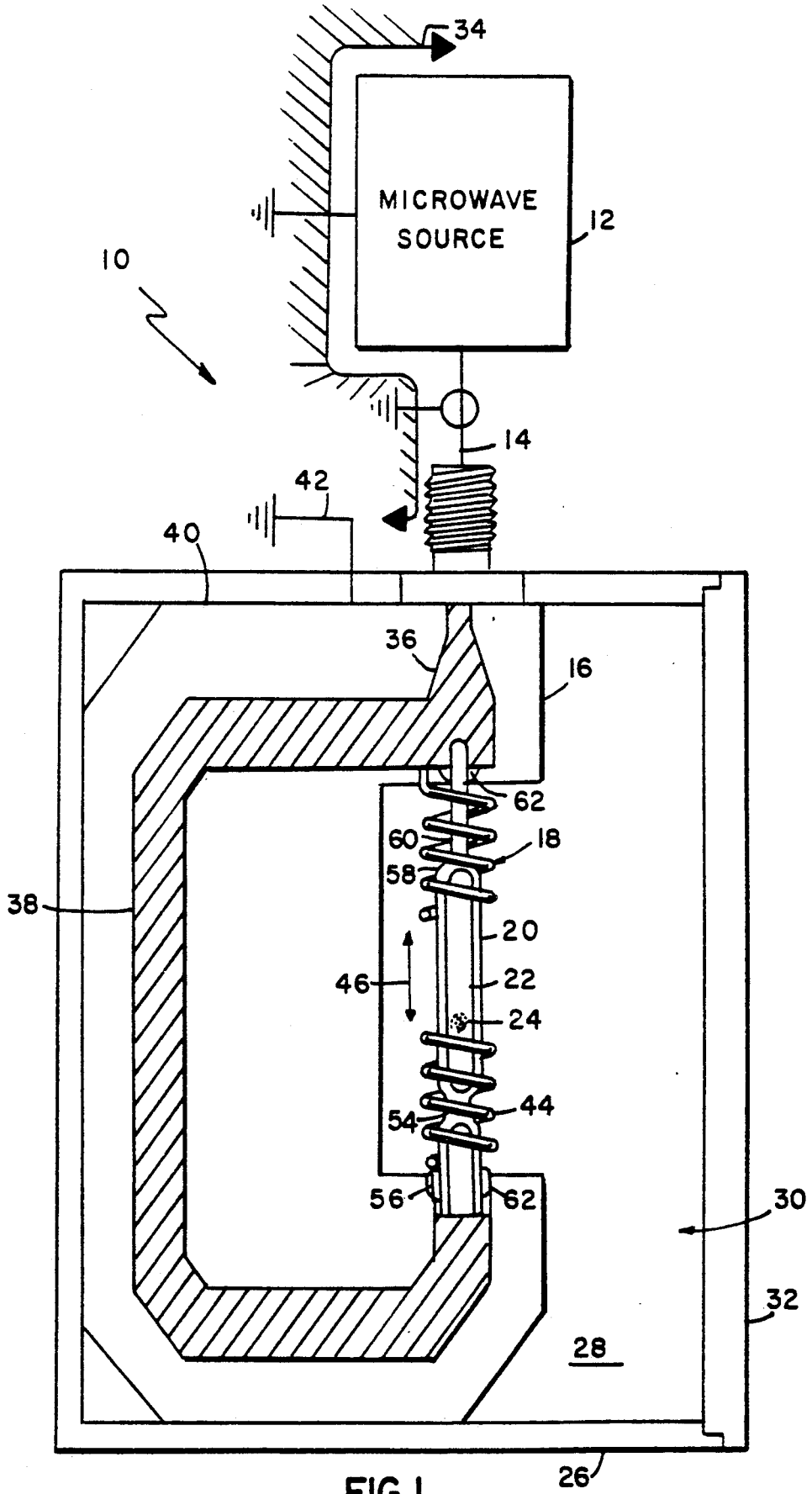
FIG. 1 shows, in part a block diagram, and in part, a cross sectioned electrodeless HID headlamp system.
Figure 2:
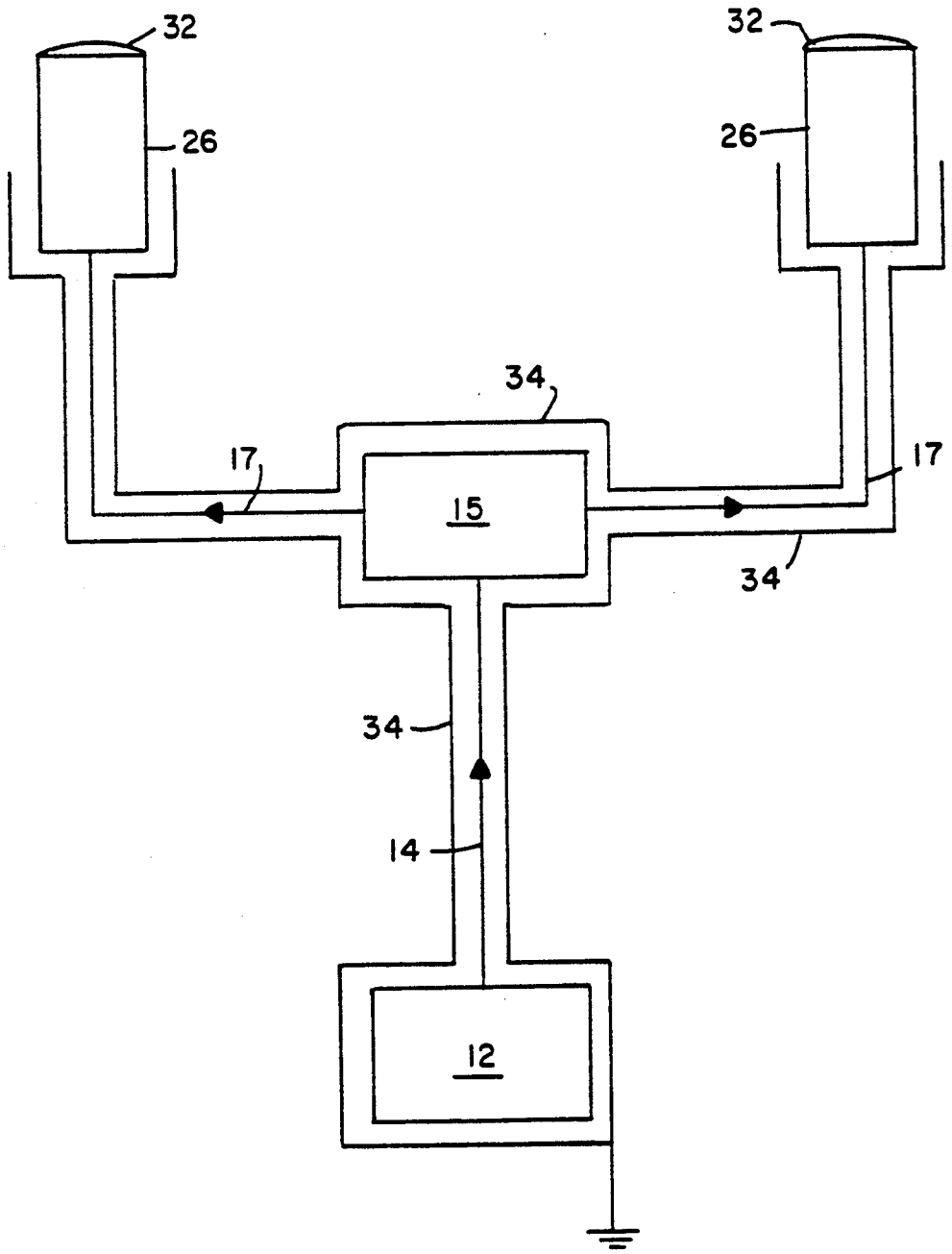
FIG. 2 shows a block diagram of an alternative electrodeless headlamp system with several headlamps powered by a single source using a power divider.

FIG. 1 shows, in part a block diagram, and in part, a vertically cross sectioned electrodeless automobile headlamp system 10. The electrodeless headlamp system 10 comprises a remote radio frequency source 12, a radio frequency transmission line 14, a support card 16, a radio frequency coupler 18, a closed lamp capsule 20 having an enclosed volume 22 containing a radio frequency excitable lamp fill 24. The support card 16 holding the radio frequency coupler 18 and the capsule 20 are designed to be positioned in, or coupled to a reflector housing 26 with a reflective surface 28 defining an optical cavity 30 to enclose the lamp capsule 20. The optical cavity 30 may be covered by a lens 32. An alternative block diagram layout is shown in FIG. 2 where a single radio frequency source 12 supplies power to a transmission line 14 leading to a power divider 15 which in turn couple through multiple transmissions lines 17 to several headlamps. The whole system of multiple headlamps may be formed as a single enclosed structure. An insulative shield 34 may be placed around portions of the structure, and grounded.

The radio frequency power source may be any conventional power source capable of providing a selected frequency and power output. The preferred radio frequency source 12 should produce a radio frequency power capable of inducing breakdown of the enclosed lamp fill 24, and in particular a high frequency source having a frequency from 10 MHz to 300 GHz is preferred. The range of legally allowed radio frequency beams may be smaller than the physically useful range, so the frequency may be further limited to the standard ISM frequencies such as from 902 MHz to 928 MHz, or the ISM band centered at 2450 MHz. The preferred frequency used for the embodiment shown in FIG. 1 was 915 MHz, as this frequency is a legally permitted choice. An example radio frequency source 12 had an impedance of about 50 ohms. For reliable starting the microwave induced electric field inside the lamp capsule 20 should be greater than that needed to induce breakdown, which for standard lamp fills 24 is about 150 volts per centimeter. The requirements for field breakdown may be lowered substantially by using Penning gas mixtures, or applying a bright ultraviolet light to the capsule 20. If necessary, a radio frequency power source 12 may be mounted on a heat sink near the capsule 20.

Radio frequency power is fed through the transmission line 14 and the coupler 18 into the capsule 20. In the preferred embodiment the wave guide, or transmission line 14 has a high coupling coefficient to deliver as much of the generated radio frequency power to the excitable lamp fill 24 as possible. The transmission line 14 should therefore be matched to the radio frequency source 12 to reflect as little of the generated power as possible. While it is possible to conduct the radio frequency power through a wave guide, the preferred transmission line 14, is a coaxial cable capable of carrying up to 100 watts of power at the selected operating frequency, for example 915 MHz. or 2450 MHz.

The power from the transmission line 14 is delivered to a coupling system that applies the power to the capsule 20. The power delivery system may be fabricated from printed circuit board material using stripline or microstripline technology, for example, as described by Gardiol and Hardy. Stripline or microstripline technology is lightweight, inexpensive, readily manufacturable, and compact when compared to waveguides at frequencies of 915 MHz or 2.45 GHz. The preferred coupling system is a support card 16 in the form of a thin, planar card formed from an insulative substrate. The support card 16 substrates may be made of fiberglass reinforced epoxy, or polytetrafluoroethylene (PTFE) filled fiber glass for lower power loss at the higher frequencies. Such boards are typical of electronic circuit board construction. Other suitable materials such as ceramics, or appropriate plastics may be used. The support card 16 substrates may be formed in varying geometries, planar shapes being particularly easy to manufacture. The printed circuit card 16 is a convenient way to support the helical couplers 18, 44 and the lamp capsule 20, while adequately delivering the supply power. In one embodiment, the support card 16 roughly had the shape of a rectangle with a notch formed along one of the longer sides. The notch was sufficiently large to include the couplers 18, 44 and capsule 20 in axial alignment.

In the preferred embodiment, a first side of the support card 16 includes a conductive strip 36 of appropriate dimension to form a 50 ohm microstrip transmission line having the same impedance as the power source 12. The power from the transmission line 14 is delivered through the 50 ohm microstripline conductive strip 36 with a half wavelength section comprising a balanced feed to the helical couplers 18, 44. The appropriate dimensions for a microstrip transmission line vary according to the dielectric constant and thickness of the substrate material. The relevant design rules are well known and discussed in standard text books, for example, High Frequency Circuit Design, J. K. Hardy, Reston Publishing Co., Reston VA (1979), or Reference Data for Engineers: Radio Electronics Computer and Communications, E. C. Jordan ed., Howard W. Sams & Co. Inc., Indianapolis, IN (1985) hereby incorporated by reference. In a preferred embodiment, a coaxial stripline launcher couples the input power signal to the stripline conductive strip 36, and conducts the received input power to at least a first coupler 18. In the preferred embodiment, a microstripline extension 38 extends around to the support card 16 to a second coupler 44. The input power is then split at the node by making the extension strip 38 with a length equal to about one half wavelength (computed in the waveguide used), for example, for the received power's signal frequency. The microstripline 36 and extension 38 then control the phase relation between the first coupler 18, and second coupler 44. By properly adjusting the length of the microstripline extension 38, the first coupler 18 may then be 180° out of phase in delivering power to the capsule 20 with respect to the second coupler 44. In one embodiment, the conductive extension 38 roughly had the shape of a "G" following, but offset from the edge of the support card 16.

In the preferred embodiment, the opposite, or second side of the support card 16 preferably has a conductive ground strip or ground surface 40 (not shown) that may be electrically grounded 42. The support card 16 is a convenient method of receiving the input from the radio frequency source 12, conducting the received power along the conductive strip 36, and extension 38 to the couplers 18, 44, while supporting the capsule 20. Other support systems for the capsule 20, and other phase delay power delivery systems for the capsule 20 may be devised.

The half wavelength microstrip transmission line 36 and extension 38 perform an additional function. The microstrip transmission line 36 and extension 38 constitute a balun impedance transformer as described by Horowitz and Hill and the Amateur Radio Handbook. A balun impedance transformer device permits approximate impedance matching of the microwave power source 12 and the 50 ohm coaxial transmission line 14 and to the cold lamp capsule 20. While the plasma impedance of the excitable lamp fill 24 varies considerably from start up to steady state operation, the balun presents a four to one (4:1) reduction in impedance variation to the microwave power source 12. Severe mismatch is therefore unlikely to develop.

The helical couplers 18, 44 are dimensioned with respect to the lamp capsule 20 size according to equations 1 and 2 below. In the preferred embodiment, the helical couplers 18, 44 have the same sense of rotation, that is, both have right handed coils, or both have left handed coils. The helical couplers may have the opposite rotational sense, but lamp starting and operation are then thought to be less good. The opposed ends of the helical couplers 18, 44 are separated by a gap 46 having a length of about one fourth of the compressed operating wavelength, $\lambda_g/4$. The lamp capsule 20 is then placed in the gap 46 between the helical couplers 18, 44 to be coaxial with the helical couplers. Each end of the enclosed volume 22 of the lamp capsule 20 is aligned approximately with the last turn of an adjacent, respective helical coupler 18, 44.

The helical couplers 18, 44 are intended to couple energy into the lamp capsule 20 and need not contact the lamp capsule 20 directly. In the preferred embodiment, the helical couplers 18, 44 do not touch the lamp capsule 20, but are slightly offset from the capsule 20. Offsetting the helical couplers 18, 44 from the lamp capsule 20 helps minimize heat conduction losses and electrochemical migration of fill salt components in the lamp capsule 20. The reduced heat conduction permits rapid warm-up of the lamp capsule 20 with consequent lamp fill 24 volatilization and increase in light output. For automotive applications, rapid warm up is a desirable feature. Conversely, keeping the couplers 18, 44 close to the capsule 20 aides energy transfer through the evanescent wave around the couplers 18, 44 to the capsule 20.

The helical couplers 18, 44 are made of a metal with a suitable skin depth and resistance to oxidation and corrosion. If a headlamp is sealed in an inert atmosphere, the oxidation and corrosion resistance requirement may be relaxed. Metals such as nickel, tungsten, molybdenum, Alloy 42 and tantalum work well. Silver or gold plated wires, for example, silver plated nickel wires are good choices for the helical couplers 18, 44. The plating increases the electrical conductivity of the wires, making energy delivery to the lamp capsule 20 more efficient.

In one example, the helical couplers were designed for operation at 915 MHz, using a lamp capsule of internal diameter 2.0 millimeters and outside diameter of 3.0 millimeters. The helical couplers were fabricated from gold plated nickel wire 0.508 mm (0.020 inch) diameter. The helical couplers had an outside diameter of 5.0 millimeters, a pitch p of 1.22 millimeters for five turns of coil, implying a total helical coupler length of 6.1 millimeters ($5 \times 1.22$). The helical couplers' inside diameter was therefore 5.0 minus two times 0.508 mm (0.020 inch) or about 4.0 millimeters. The lamp capsule then fitted in the final turn of the helical coupler without touching and was separated from the helical coupler by about 0.5 millimeters around the capsule's circumference. The helical coupler generated a quarter wave length, $\lambda_g/4$, of about 9.0 millimeters. The evanescent waves of the couplers 18, 44 thereby substantially covered the enclosed volume 22.

Figure 3:
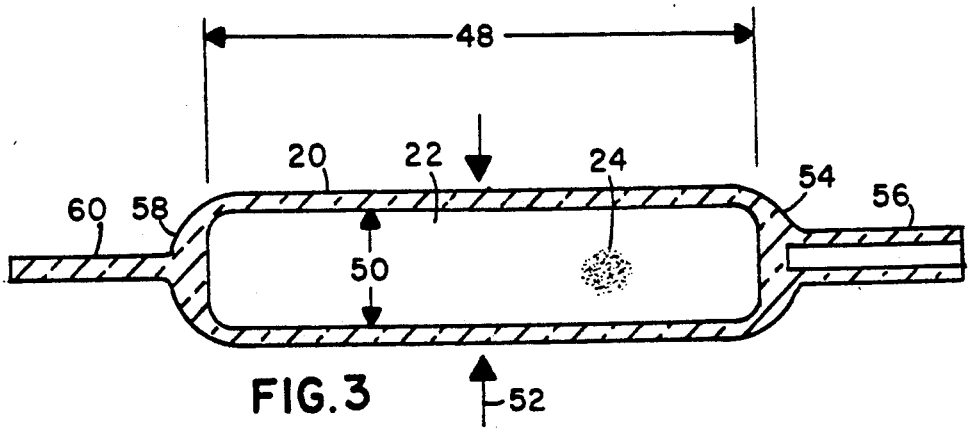
FIG. 3 shows an axial cross sectional view of a preferred embodiment of an electrodeless HID capsule.

FIG. 3 shows a preferred embodiment of a capsule 20. The capsule 20 should be formed to have at least one radio frequency input window to allow radio frequency power to pass into the capsule 20 enclosure. The capsule 20 should also be formed to have at least one optical window to allow generated light to pass from the capsule 20 enclosed volume 22. In the preferred embodiment the capsule 20 is a quartz or similar light transmissive capsule 20. For an approximately linear source 12 construction, the capsule 20 is preferably a circular tube with sealed ends, preferably geometrically regular ends, such as planar or spherical section ends. The regular geometry of a circular tube with either planar or spherical ends yields a well defined light distribution. Little or no stray light is then created by the regularly formed capsule.

A small lamp capsule 20 has been found to have particularly useful features A small capsule 20 may be made of a radiant energy transmissive material such as quartz defining an enclosed cylindrical volume having an internal length 48 less than 20.0 millimeters, and preferably about 9.0 millimeters. When the lamp capsule 20 becomes extended in length, say 15.0 millimeters, it is increasingly difficult to maintain an even luminosity along the length of the capsule 20. Using two couplers 18, 44 coaxial with, and separated along the capsule 20 length helps maintain even excitation of the enclosed lamp fill 24. When the enclosed volume 22 is less than about 9 or 10 millimeters, the required pitch on the coiled couplers at 915 MHz. becomes so small that breakdown of the air around the helical couplers 18, 44 occurs at the power levels required to sustain the arc discharge. A suggested cure for air gap breakdown is to enclose the lamp in an evacuated jacket.

The internal diameter 50 of the enclosed volume 22 may be less than about 5.0 millimeters, and preferably about 1.0 or 2.0 millimeters. When the lamp capsule 20 is narrow the excited portion of the lamp fill 24 fills the whole enclosed volume 22, resulting in an even luminosity across the axis of the lamp capsule 20. The narrowness of the internal volume 22 is felt to suppress radial turbulence in the lamp fill 24 at the temperature and pressure of operation. If the lamp capsule 20's internal diameter 50 is enlarged, an arc line may form, that while possibly a more narrow light source, may be less positionally stable than the evenly excited lamp fill 24. The overall lamp optics may then be less reliable with a larger internal diameter 50 capsule 20. Color separation and localized heating of the lamp capsule 20 wall may also result from a larger internal diameter 50.

The lamp capsule 20 wall may be about 0.5 to 1.5 millimeters in thickness giving an outside diameter of about 2.0 millimeters to 8.0 millimeters depending on the capsule wall thickness. The preferred capsule 20 has about a 9.0 millimeter internal length 48, a 20 millimeter internal diameter 50, and a 3.0 millimeter outer diameter 52. The preferred lamp capsule 20 has been found to provide a very even source of light, both as to color and luminosity.

The lower limits on the respective capsule 20 dimensions are a matter of practical manufacture. The capsule 20 wall must be thick enough to sustain the internal lamp fill 24 pressure, given the heating of the capsule 20 and the enclosed lamp fill 24. The lamp capsule 20 internal length 48 and diameter 50 must be sufficient lamp large to be reliably dosable with the excitable lamp fill 24. Also, the wall thickness must be sufficient to sustain the thermal flux, which depends on numerous variables including the energy input, the lamp capsule 20 material, the lamp fill 24, exterior convection and the lamp capsule 20 geometry.

The capsule 20 encloses a lamp fill 24, that may include various additional doping materials as is known in the art. The lamp fill 24 composition is chosen to include at least one material that is vaporizable and excitable to emission by the radio frequency power. The lamp fill 24 compositions useful here are in general those familiar to arc discharge tubes, most of which are felt to be applicable in the present design. The preferred gas is a Penning mix of largely neon with a small amount, less than 1%, argon, although xenon, krypton, argon or pure neon may be used. The lamp fill preferably includes a metallic compound, such as a metallic salt. Scandium iodide is a preferred metallic salt. One such lamp fill composition is 0.3 milligram of metallic mercury, 0.1 milligram of sodium-scandium iodide. Twenty torr of a Penning gas mix consisting of 0.0048% argon in neon was used in a volume of about 0.03 $cm^3$.

The preferred capsule 20 also includes one or more coupling projections such as axial extensions at each axial end to enhance the support of the capsule 20. Since the body of the preferred capsule 20 is a tube, the easiest extension to form is a continuation of the same tube structure, given the necessary seals for the enclosed volume 22. In one embodiment, the capsule 20 was press sealed 54 in an intermediate section of a tube. An unsealed tubular extension 56 was left extending axially away from the enclosed volume 22. The tubular extension 56 was then used to mechanically couple the capsule 20 to the support card 16. After the enclosed volume 22 was filled with the selected lamp fill 24, the capsule 20 was sealed at an opposite end 58. In one embodiment, the opposite end of the capsule 20 was melt sealed leaving a rod 60 extending axially away from the enclosed volume 22. The rod 60 was similarly used to mechanically couple the capsule 20 to the support card 16. References to the external length of the capsule mean the internal length of the enclosed volume plus the capsule wall thickness, and do not include the lengths of external support projections which may have any convenient length.

A method of mechanically supporting the lamp capsule 20 is to fasten the support card 16 to the lamp capsule 20 with an elastomeric adhesive 62 such as a room temperature vulcanizing cement. Similarly, dielectric 'V' blocks may be used to accurately position the lamp within the couplers 18, 44. Slides, clips, and other similar mechanical couplers may be adapted from known designs. Preferably there should be some flexibility between the support card 16 and the capsule 20, or some other means of accommodating thermal expansion of the capsule 20 as to its support. When the capsule 20 is heated during operation, it is likely to expand, and should not be subjected to undue stress caused by rigid clamping to an immovable support. Such thermal expansion induced stress may cause premature lamp failure, or deform the light source with respect to the optical elements resulting in a wandering beam pattern.

When finally positioned, the ends of the enclosed volume 22 are preferably opposite, and radially interior from the free ends of the helical couplers 18, 44. In the preferred embodiment, there is an overlap of about one turn of each helical coupler with each adjacent, respective axial end of the enclosed volume 22. The remaining portion of the enclosed volume 22 extends coaxially between the two helical couplers 18, 44 in the gap 46 region. Little or none of the enclosed volume 22 is then radially blocked from view by the helical couplers 18, 44.

The coaxial alignment of the helical couplers 18, 44 provide a compressed electromagnetic wave having electric field components that are substantially coaxial with the helical couplers. Similarly, the electric field components may be aligned to be coaxial with the capsule. When the radio frequency power enters the capsule 20 to interact with the lamp fill 24, the lamp fill 24 is excited to a plasma state. The excited lamp fill 24 then emits visible light, which exits the optical window. The discharge plasma may have a temperature of as much as 6000° K. and so must be adequately separated from the capsule 20 wall. The arc discharge is not attached to the wall or any other physical boundary, but has a generally circular cross section normal to the direction of the induction field. The discharge is then suspended in the discharge vessel near where the induction field is greatest. The overall shape of the discharge is determined by the gravity, diffusion, radiation transport, electrodynamic and thermodynamic forces. In the small capsule 20 design, the narrow internal diameter of the lamp capsule is felt to suppress the convective flow. As a result, heating occurs evenly across the whole enclosed volume 22 and enclosed lamp fill 24, thereby sustaining the lamp capsule 20 wall at a near isothermal condition. The measured temperature gradients were less than about 50° C. from top to bottom in either the vertical or horizontal positions. As a result, light generation occurs evenly across the whole enclosed volume 22 lamp fill 24. Similarly, chemical fill and gas components are felt to be evenly distributed through the enclosed volume, yielding even wall loadings and little if any color separation.

Figure 4:
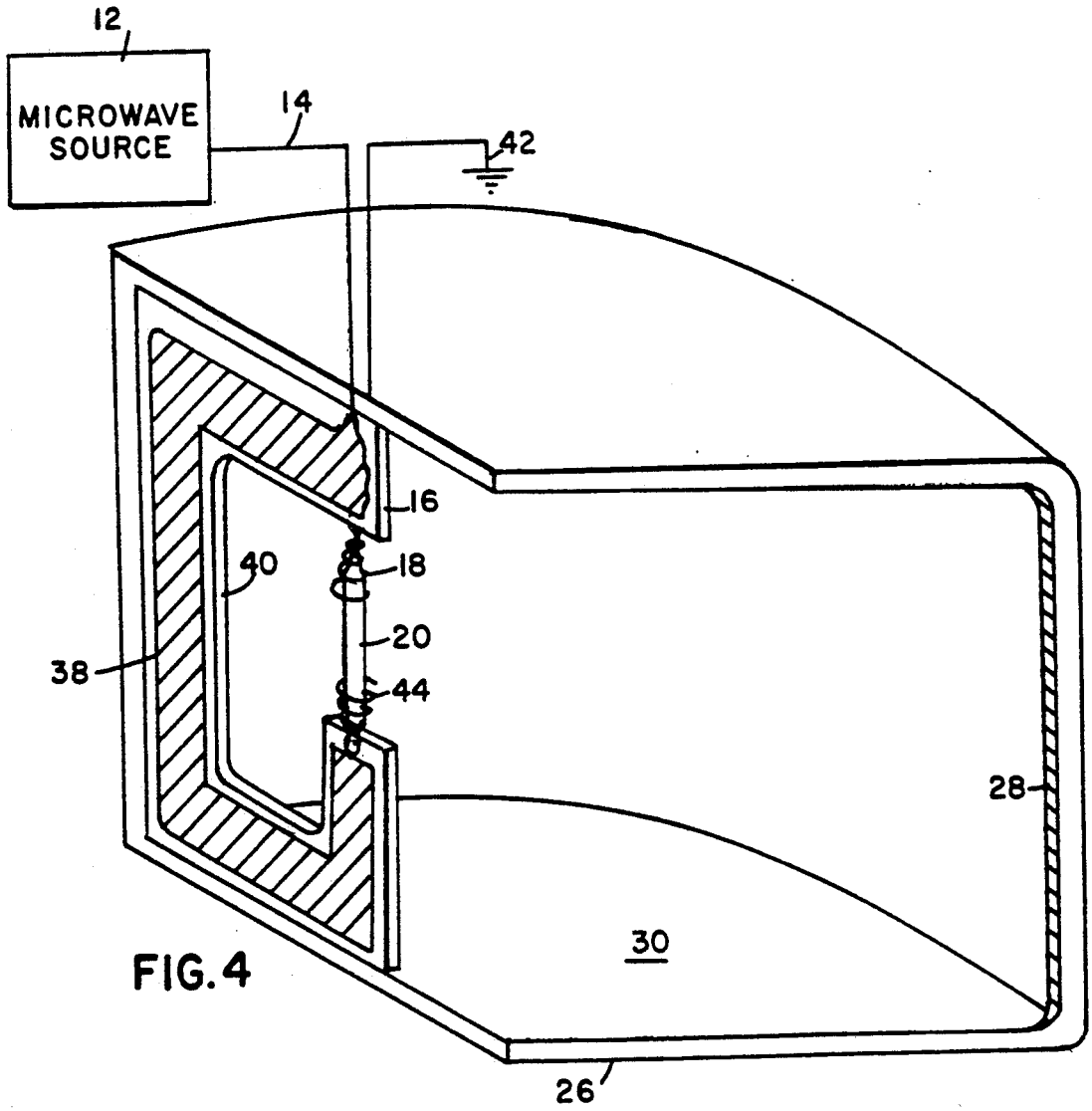
FIG. 4 shows a front perspective view of a cross sectioned electrodeless HID headlamp system.

FIG. 4 shows a front perspective view of a support card 16, two couplers 18, 44 and a capsule 20 mounted in a reflector 26 with reflective surface 28. The reflector 26 may have a paraboloidal form truncated by planes parallel to the reflectors optical axis. The reflector 26 is vertically cross sectioned through the reflector axis. The reflector 26 includes an interior surface that defines an optical cavity 30, at least a portion of which is made reflective 28. The reflector 26 may be made of glass, ceramic, plastic or metal as is generally known in the art and may possess a conductive or absorptive layer to contain the radio frequency energy. The reflective layer 28 may be polished metal, a dichroic coating, a deposited metal coating, or other reflective surface structure as may be known in the art. The reflector preferably includes an arched or faceted surface for projecting the visible light generated in the capsule at or near an optical focus towards a predetermined region or pattern of projection. Headlamps are normally required to project light according to regulated patterns, and the reflector 26 design is chosen in part to coact with the light distribution pattern generated in the enclosed volume to achieve the desired display pattern.

The reflector cavity 30 may be closed by a bridging lens 32. Alternatively, the lens 32 may be positioned in front of the reflector 26, and supported by other support means. The lens 32 may include facets, lenticules or similar prismatic elements to assist in directing the generated light to the desired location, or beam pattern. The preferred lens 32 is composed of a material highly transmissive to visible light, such as glass, or plastic. Similarly, the preferred lens is designed to coact with the reflector, and lamp capsule to produce a prescribed beam pattern.

In the preferred embodiment, the capsule 20 is mounted by appropriate means at the optimum optical position in the reflector 26 and lens 32 assembly, for example at the focal point of a paraboloidal reflector housing 26. The support card 16 may be positioned to be coplanar with the axis of the reflector 26, abutting or coupled to the reflector 26 along the support card 16 edges. Little or no useful light is lost by the coplanar positioning of the support card 16. The capsule 20 may be oriented horizontally, vertically, or at any intermediate angle, since the light generation is substantially the same regardless of capsule 20 orientation. A lamp designer need not compromise the overall lamp design to accommodate the physics of the light source. The particular lamp capsule 20 orientation may then be chosen to take advantage of reflector 26, lens 32 or illumination field characteristics.

Surrounding all or portions of the radio frequency source 12, the transmission line 14, and the reflector, which houses the capsule 20, may be a radio frequency reflector or insulative shield 34. The insulative shield 34 is not felt to be absolutely necessary, as a shielding housing for the source 12, a quality transmission line 14, and a reflector capsule 20 system 10 may be designed such that little or none of the radio frequency signal escapes to the exterior of the headlamp system 10. It may be more important to use shielding 34 to keep water, dirt, heat and other environmental influences out. Applicant recognizes the difficulty, and expense of making such a leakproof system 10, and therefore suggest the use of a sealed metal containment enclosing the source 12, the transmission line 14 and the back portion of the reflector 26. The front side of the reflector 26 is necessarily open to allow the release of the generated visible light.

Numerous means for coupling a radio signal from the transmission line into the capsule are known. A single ended coupler may be used. The preferred coupling system has two couplers 18, 44 separated by a gap 46 and positioned coaxially to direct power towards each other. The capsule 20 may then be positioned in the gap 46 between the couplers 18, 44. The couplers 18, 44 may be supported from the support card 16, or may be supported by the reflector housing 26. The preferred couplers 18, 44 are helical slow wave type couplers positioned coaxially to sustain the required electromagnetic field in the gap 46. The use of opposite facing couplers 18, 44 supplying power 180° out of phase is particularly effective in exciting a uniform discharge in the enclosed capsule 20. The coupler design is related to the capsule 20 structure chosen. If the capsule 20 has a length of less than about 9.0 millimeters, and the operation frequency is chosen to be 915 MHz., then the pitch on the helical couplers 18, 44 becomes so small that the air gap separation between turns of the helical couplers 18, 44 is to small to be an adequate insulator. The air gap then breaks down at the power levels needed to sustain the arc discharge in the lamp capsule.

The lamp capsule 20 is energized with microwave power preferably applied symmetrically to the lamp capsule ends by slow wave helical couplers 18, 44. The preferred method of application is similar to one taught by McNeil et al. in U.S. Pat. No. 4,178,534 and is hereby incorporated by reference. The dual ended excitation serves to stabilize the arc as suggested by McNeil et al. in U.S. Pat. No. 4,266,162 also hereby incorporated by reference. A novel feature of the present structure is the dual ended excitation of a very short arc tube. Dual excitation applied to a very short arc tube coupling has been found to produce a very straight, narrow arc discharge comparable to an incandescent filament. In addition, the arc discharge produced is a universal burner, meaning the lamp capsule 20 is orientation tolerant and may be operated vertically, horizontally or anywhere in between. The preferred orientation is vertical.

The linear nature of the arc discharge is believed to be due to the hybrid electromagnetic wave propagating on the helical coupler 18, 44. The hybrid electromagnetic wave has both electric and magnetic field components in the direction of energy flow in contrast to the familiar transverse electromagnetic wave. Consequently, electrons are accelerated along the electric field lines, generally coaxially with the helical couplers 18, 44 The coaxial electron acceleration is then similar to the electron acceleration in an electroded arc. In contrast to an electroded arc, the coaxial electron acceleration is further confined to the lamp capsule axis by the axial component of the magnetic field. As a result the electron acceleration is more strongly axial than in an arc discharge formed between the electrodes of an electroded arc discharge lamp capsule. The electric and magnetic field orientations move with the lamp orientation and tend to overpower gravitational effects. The strongly axial arc discharge then enhances the evenness of the arc luminosity. Narrowing the internal volume diameter suppresses radial convection and thereby further enhance the evenness of the arc luminosity.

The slow wave helical couplers act to compress the wavelength of the propagating wave. With a compressed wavelength, the dimensions of a resonant structure may be made very small relative to the free space wavelength. A small resonant cavity is then a useful feature of the present design enabling an approximately filament size discharge. As an example, the free space wavelength, $\lambda_o$, of 915 MHz radiation, is about 320 millimeters. Whereas the compressed guide wavelength, $\lambda_g$, is about 40.0 millimeters. A quarter wave quasi-resonant structure (the internal volume of the lamp capsule), may then be formed where the gap 46 between helical couplers 18, 44 is about 10.0 millimeters. The small quasi-resonant structure has approximately the same dimension as the lamp capsule, and the lamp may then be positioned in the helical coupler gap 46. The smallness of the quasi-resonant lamp capsule 20 has been unattainable using conventionally resonant structures such as rectangular or cylindrical cavities at the preferred operating frequencies in the allowed ISM bands centered at 915 MHz and 2450 MHz.

The slow wave structure employed in the design has a ground plane at a large distance. Accordingly, the equations for the axial field wavelength generated in the slow wave helical couplers 18, 44 are approximated in the limit by a large ground shield radius, b. In particular, as the ground shield radius b varies between 10 to 100 times the helix radius, a, the log of their ratio (b/a) varies between 1 and 2. The small log variation term may be substantially neglected in comparison with the remaining terms and with the ratio of a/b for large b.

Consequently, the expression for the wavelength along the helical couplers, $\lambda_g$, may be written as:

Equation 1:

$$\lim_{b > a} \lambda_g = \lambda_o \frac{p}{\sqrt{2}\ \pi a} \{1 - (p/2\pi a)^2\}$$

Equation 2:

$$\lambda_g \simeq \lambda_o \frac{p}{\sqrt{2}\ \pi a}, \text{ for } p < a$$

In the limit where the outer ground shield radius is larger than the helical coupler radius, b>a, where a is the helical coupler radius, b is the radius of the usually present, coaxial, outer ground shield. The pitch or interturn spacing of the helical couplers is p, and the free space wavelength is $\lambda_g$. In the limit where the outer ground shield is much larger than the helical coupler radius, b>>a, the ground shield need not be cylindrical or even concentric with the helical coupler. In fact, an aluminized or substantially metallic or conductive reflector, for example a paraboloidal reflector typical of reflector lamps, in which the lamp capsule 20 may be mounted, may be used as the ground plane.

Figure 5:
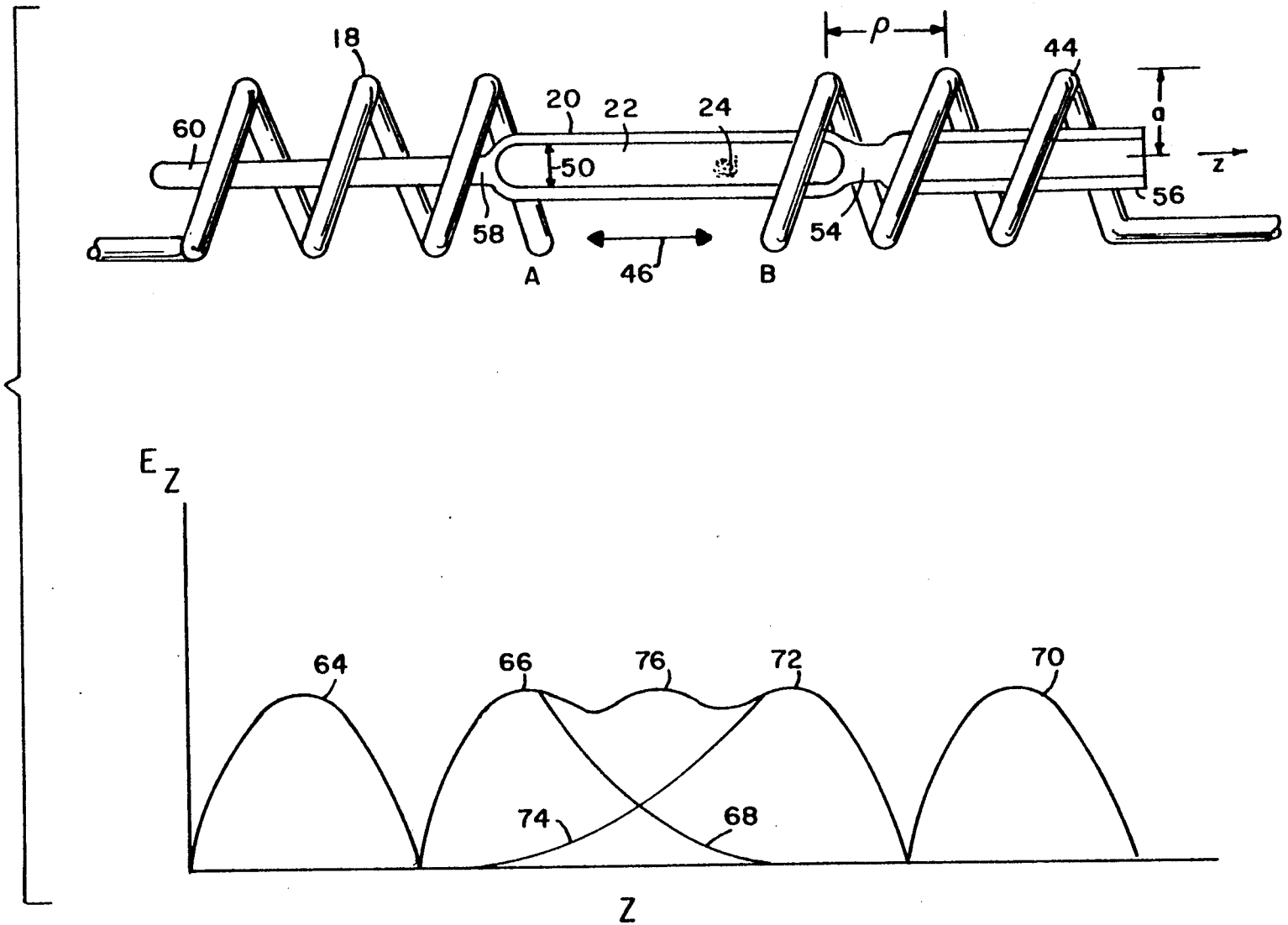
FIG. 5 shows a lamp capsule positioned between two helical couplers, in alignment with a chart of the corresponding axial electric fields generated by the two helical couplers.

The microwave power is coupled into the arc discharge lamp capsule 20 by the slow wave axial field at the end of the helical coupler. For efficient lamp capsule 20 operation, the lamp capsule 20 need not be positioned exactly within either of the convex volumes defined by a helical couplers 18, 44. FIG. 5 shows a lamp capsule positioned between two helical couplers, in graphic alignment with a chart of the corresponding axial electric fields generated by the two helical couplers 18, 44. The placement of the lamp capsule 20 in the helical couplers 18, 44 is such that a first electric field 64 produced by the first helical coupler 18 has a field maximum 66 near a first end of the enclosed volume 22, approximately adjacent the second seal 58 of the lamp capsule while a field minimum 68 occurs at the opposite, second end of the enclosed volume near the first seal 54. In the preferred embodiment, the evanescent field generated by the first helical coupler is just sufficient to cover the enclosed volume 22, and just sufficient to cause breakdown in the lamp fill. In the preferred embodiment, a similar, simultaneous, second electric field 70 is produced by the second helical coupler 44. The second electric field 70 has a field maximum 72 near the opposite end of the enclosed volume 22 near the first seal 54 while an electric field minimum 74 occurs at the first end, near second seal 58. By superposition, the first field 64 and second field 70 may be added to produce a net field distribution 76 as depicted in FIG. 5. The z direction coincides with the axis defined by the helical couplers. The local maxima and minima in the resulting electric field have been observed experimentally.

In the preferred embodiment, the electromagnetic excitation of each helical coupler 18, 44 is out of phase by 180° with respect to the other. The instantaneous microwave voltage on the helical couplers 18, 44 out of phase by 180° due to the one half wavelength delay line formed by the microstrip transmission line extension 38. Consequently the voltage magnitude across the lamp capsule 20 is doubled. Doubling the voltage magnitude across the lamp capsule 20 assists cold starting the lamp capsule 20.

Power from the transmission line 14 is coupled into the lamp capsule 20 via the evanescent wave from the ends of the respective helical couplers 18, 44. Helical slow wave antennae are known in the literature as taught by Walter. (C. H. Walter, *Traveling Wave Antennas*, McGraw Hill, NY 1965.) The dimensions of the helical couplers 18, 44 are purposely chosen to make the helical couplers nonradiating devices to substantially reduce radiated power and thereby conform to health and safety specifications, such as ANSI (C95.1-1982). The helical coupler dimensions are therefore selected so each helical coupler is an ineffective radiator. Consequently power from the helical coupler 18, 44 may be delivered best to a load, such as the capsule 20 and lamp fill 24, when the load is close enough to the helical couplers 18, 44 to be substantially in range of the evanescent wave surrounding each helical coupler. For example, each lamp capsule end may be positioned coaxial with the helical coupler with the axial end of the enclosed lamp capsule volume approximately adjacent the axial limit of the convex volume defined by the helical coupler.

Figure 6:
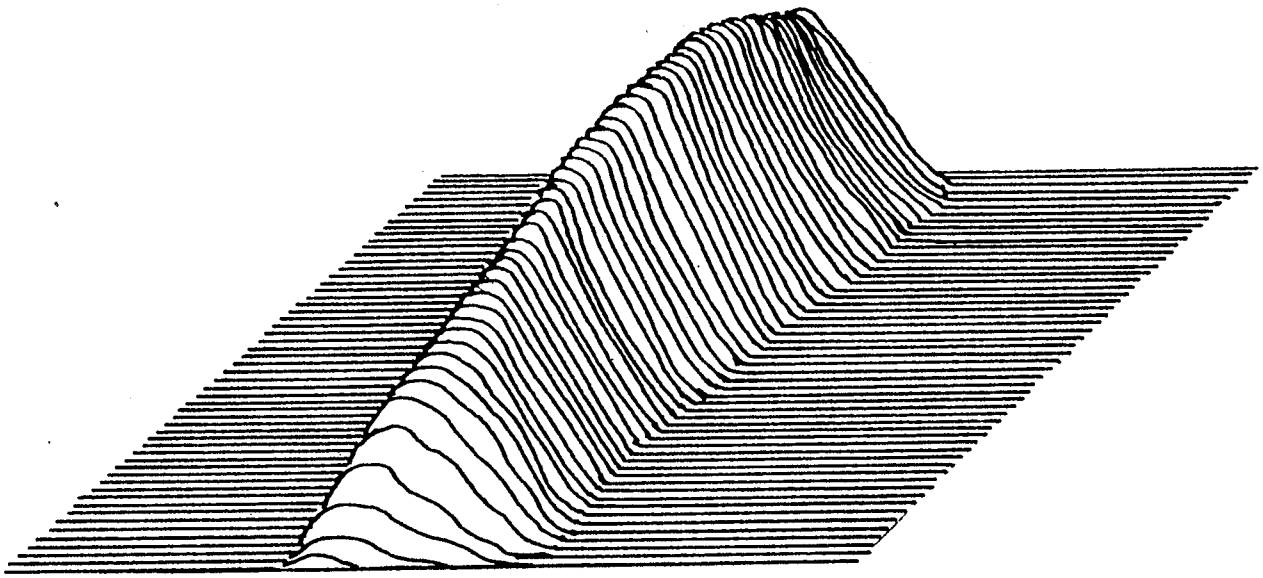
FIG. 6 shows a luminosity contour characteristic of a representative electrodeless arc discharge lamp.

FIG. 6 shows a charting of luminosity from an electrodeless lamp having dimensions slightly larger, but still representative of the size electrodeless lamp claimed. The sample electrodeless lamp was tested to burn horizontally. The chart shows a smooth rise in luminosity from the lamp walls towards the lamp axis, for all points along the lamp axis. There is a somewhat smaller rise near the axial ends, but nonetheless an even rise. The chart also shows a smooth rise in luminosity near each end of the capsule, running parallel to the lamp axis. For each radii, there is then an approximately level luminosity for the length of the capsule. The luminosity adjacent the capsule wall is small, while the luminosity near the middle is high. Overall, the chart shows a smooth luminosity surface extending from end to end and side to side for the electrodeless lamp. The luminosity surface is very stable over time, since the region of excited lamp fill extends to, but is pinned by the lamp walls. The smooth stable light from the lamp may be easily accommodated in reflector and lens designs. Since the light source is stable, an optical design does not have to accommodate variations from the optically ideal position, as may occur in a wandering arc. Similar results may be found in the preferred embodiment.

Figure 7:
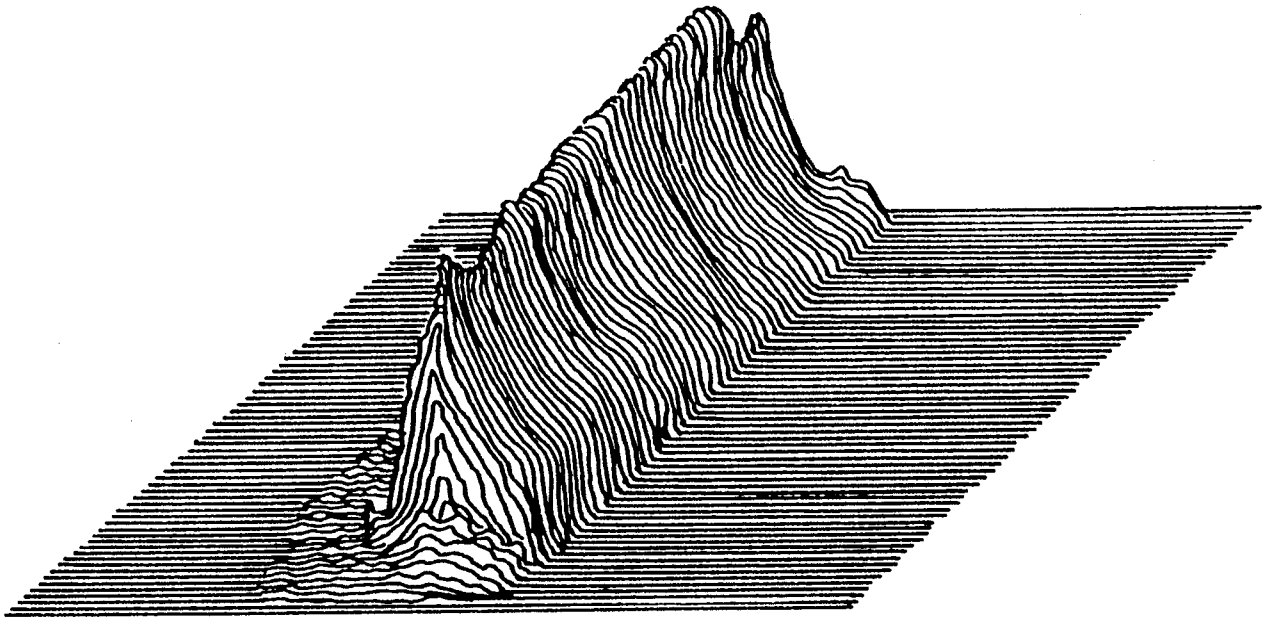
FIG. 7 shows a luminosity contour characteristic of a representative electroded arc discharge lamp.

In contrast, a similar charting in FIG. 7 shows the luminosity for a similar size electroded HID lamp burning horizontally. While the data in FIG. 6 is from a small electroded HID lamp having larger dimensions than the electrodeless example, the data is typical of electroded discharge lamps. The electroded lamp chart shows a ragged surface with rough end regions corresponding to the electrode tips, and a high, albeit narrow axial peak corresponding to the arc line. The arc in the electrode lamp may waver, so the charting is only for a particular instant in time.

Figure 8:
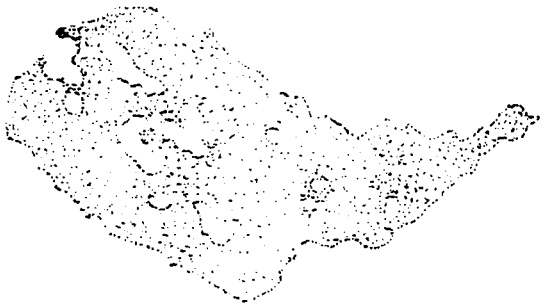
FIG. 8 shows a light distribution chart characteristic of a representative electroded arc discharge lamp.

FIG. 8 shows optical source distribution of an electroded type arc discharge lamp of comparable size to the electrodeless lamps claimed herein. The figure shows how the light source deviates from the ideal point, or line source that is most desired for optical design. The axes represent the width and length of the source, while the darkness of the pattern represents the intensity of the source within a particular zone. The electroded arc discharge source pattern is roughly in the shape of a rhombus with the length of one side about twice the length of the width. A tail extends amorphously from one corner.

Figure 9:
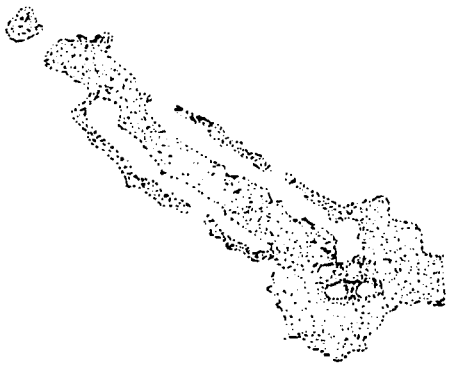
FIG. 9 shows a light distribution chart characteristic of an electrodeless arc discharge lamp.

FIG. 9 shows a corresponding optical source distribution pattern for a microwave discharge device made according the to present design. The microwave source pattern is approximately linear with a roughly circular portion at one end. The electrodeless lamp pattern has a length roughly the same as the length in the arc discharge lamp pattern, but has a width of at most about two thirds that of the arc lamp source, comparing the circular portion, or about one sixth to one fourth that of the electrode arc discharge source looking at the linear portion. In either case, the electrodeless lamp pattern is substantially more concentrated. The electrodeless lamp more closely approximates an ideal point or linear source, and therefore results in better display patterns.

In a working example some of the dimensions were approximately as follows. The radio frequency source was driven by 15 volt direct current supply, and required 100 watts to produce 25 watts of power at 915 MHz. The radio frequency source had a solid state microwave source operating at 915 MHz. The power source was a solid state microwave source three stage oscillator amplifier configuration assembled from commercially available components. The transmission line was a standard RG142 double shielded coaxial cable. The couplers comprised two coaxial helical coils, and a half wave phasing line. The helical couplers were fabricated from gold plated nickel wire 0.508 millimeters (0.020 inches) diameter. The helical couplers had an outside diameter of 5.0 millimeters, a pitch p of 1.22 millimeters and five turns of coil, implying a total helical coupler length of 6.1 millimeters ($5\times1.22$). The helical couplers' inside diameter was therefore 5.0 minus two times 0.508 millimeters (0.020 inches) or about 4.0 millimeters. The helical coupler generated a quarter wave length, $\lambda_g/4$, of about 9.0 millimeters. The lamp capsule was a small silica (quartz) arc tube with internal dimensions of 2 millimeter diameter, and 9 millimeter length, and external dimensions of 3 millimeter outside diameter and 11 millimeter long, exclusive of the end supports. The lamp capsule then fitted in the final turn of the helical coupler without touching and was separated by about 0.5 millimeters around its circumference. The lamp capsule was mounted on a circuit board with a microstrip transmission line. A tuning circuit, and helical couplers where used to conduct the radio frequency signal to the enclosed gas. The reflector was a plastic reflector having an internal reflective surface formed by deposited aluminum. The reflector surface was a paraboloid of revolution truncated by two planes parallel to each other and to the axis of revolution. The truncating planes were spaced approximately 50 millimeter from each other, and equidistant from the reflector's axis of revolution. The electrodeless headlamp system produced a beam of about 2600 lumens in an acceptable pattern. Capsules of the type described have been operated at about 20 watts of input power, for hundreds of starts, and 1,100 burning hours. These lamps have had a maintenance of over 85%. Optical imaging of the arc showed very uniform axial intensity distributions. Such images are felt to likely provide excellent forward beam patterns with less glare than electroded HID sources.

Photographs of the microwave capsule operated at reduced power levels show the field minima fall below the net field required to sustain ionization. As a result dark areas appear at the field minima, and bright regions (plasmoids) appear where the field is sufficient to maintain the discharge. As power is increased the combined fields are everywhere sufficient to maintain ionization and the plasma becomes uniform.

The small arc source produced light with an efficiency exceeding 100 lumens per watt. This was a counterintuitive result, as most metal halide lamps become more efficient as volumes and power consumption increase. A small electrodeless metal arc lamp can be sustained with electric power of about ten watts at efficiencies of about 20 lumens per watt. This was a surprising result, since the work of Waymouth and Elenbaas indicates the heat loss alone should be about ten watts per centimeter of arc length in a metal arc lamp. The filamentary core of the small microwave arc shows almost no bowing, even over arc lengths of 15.0 millimeters. The lack of bowing was a novel result, since even small electroded metal arc lamps of arc length 4.0 millimeter show substantial bowing, and larger wattage metal arc lamps cannot be run horizontally without gravity shaping the arc. As a lamp that may be positioned in almost any direction with no change in results, the small microwave lamp capsule is particularly useful in optical systems, such as automobile headlamps, where the generated light needs to be accurately directed to particular illuminated regions.

The temperature gradient in the arc tube was also found to be surprisingly low. When aligned horizontally, the top of the capsule was hotter than the bottom by about 50° C. Further, the wall temperature is surprisingly uniform over the arc tube surface. The even wall temperature discovery helps explain the limited bowing and high efficiency. The wall temperature in the small constricted arc tubes of 750° C. to 880° C. was also lower than the expected temperature of about 1000° C. for the high wall loadings of about 32 watts per $cm^2$. The lower than expected wall temperature was new and interesting as it permits quartz to be a viable arc tube material for highly loaded walls. Ordinarily wall loadings of 26 to 30 watts per $cm^2$ for quartz are considered excessive. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A gas capsule for an electrodeless lamp comprising:

a radiant energy transmissive material defining an enclosed volume having an internal length approximately one quarter of the compressed, guide wavelength of the input power, an internal diameter narrow enough to suppress radial turbulence at the temperature and pressure of operation, with the enclosed volume filled with a lamp fill excitable by a high frequency electromagnetic field to produce radiant energy, the gas capsule adapted to be coupled to radio frequency energy by evanescent waves thereby exciting the lamp fill and causing the emission of visible light.

2. A electrodeless HID lamp comprising:

a) a radio frequency transmissive and optically transmissive envelope having an interior surface enclosing a lamp fill volume;

b) a lamp fill contained in the lamp fill volume excitable by radio frequency energy such that said lamp fill emits visible light;

c) a reflector housing having a reflective housing interior surface defining a reflector cavity, said envelope positioned within said reflector cavity; and d) means for capacitively coupling radio frequency energy by evanescent waves to the lamp fill thereby causing excitation of the lamp fill and the emission of visible light.

3. The lamp according to claim 2 further comprising:

e) means for producing a radio frequency signal and coupling the radio frequency signal to said means for coupling radio frequency energy.

4. The lamp according to claim 2, further comprising:

e) a lens covering the reflector cavity to enclose the envelope.

5. The lamp according to claim 4 wherein the lamp is headlamp having the reflector and the lens optically designed to receive the light generated by envelope to project a prescribed beam pattern for vehicle illumination.

6. The lamp according to claim 2, wherein the envelope is a tube having an internal diameter of less than 7.0 millimeters.

7. The lamp according to claim 2, wherein the envelope is a tube having an internal length of less than 18 millimeters.

8. The lamp according to claim 2, wherein the lamp fill is substantially neon with an addition of mercury.

9. The lamp according to claim 2, wherein the lamp fill is substantially neon with an addition of less than 1.0% argon, and an addition of mercury.

10. The lamp according to claim 2, wherein the lamp fill is substantially argon with an addition of mercury.

11. The lamp according to claim 2, wherein the lamp fill includes at least one metal compound.

12. The lamp according to claim 11, wherein the metal compound includes a metallic salt.

13. The lamp according to claim 12, wherein the metallic salt is a mixture of scandium iodide and sodium iodide.

14. The lamp according to claim 2, wherein the reflective surface is a section of a paraboloid, and a portion of the envelope is located at the focus of the paraboloid.

15. The lamp according to claim 4, wherein the lens includes prismatic sections designed to direct the light in a predetermined direction.

16. The lamp according to claim 2, wherein the efficiency of lamp is greater than 100 lumens per watt.

17. An electrodeless HID headlamp comprising:

a) a radio frequency transmissive and optically transmissive envelope having an interior surface enclosing a lamp fill volume, the lamp fill volume being cylindrical in shape and having an internal length between 7.0 and 10.0 millimeters and an internal diameter between 1.0 and 3.0 millimeters and having a first coupling and a second coupling end;

b) a lamp fill contained in the lamp fill volume excitable by radio frequency energy such that said lamp fill emits visible light;

c) a reflector housing having a reflective housing interior surface defining a reflector cavity, said envelope positioned within said reflector cavity; and d) means for capacitively coupling radio frequency energy by evanescent waves to the lamp fill volume thereby causing excitation of the lamp fill and the emission of visible light.

18. An electrodeless lamp comprising:

a) a radio frequency transmissive optically transmissive envelope having an interior surface enclosing a lamp fill volume; said envelope having a first coupling end and a second coupling end;

b) a lamp fill contained in the lamp fill volume excitable by radio frequency energy such that said lamp fill emits visible radiation;

c) a first coupling means positioned at the first coupling end of said envelope;

d) a second coupling means positioned at the second coupling end of said envelope wherein said first and second coupling means couple radio frequency energy to the lamp fill by evanescent waves thereby exciting the lamp fill and causing the emission of visible light, wherein said lamp envelope has an internal length approximately equal to one quarter of a compressed guide wavelength of the input power.

19. The lamp according to claim 18 further comprising:

e) means for producing a radio frequency signal and coupling that signal to said first and second coupling means.

20. The lamp according to claim 19 wherein the frequency of the radio frequency signal is 915 MHz.

21. The lamp according to claim 20 wherein the efficiency is greater than 100 lumens/watt.

22. The lamp according to claim 18 further comprising:

(e) a reflector housing having a reflective housing interior surface defining a reflector cavity, said envelope positioned with said reflector cavity.

* * * * *